US007846538B2

(12) United States Patent
Chen et al.

(10) Patent No.: US 7,846,538 B2
(45) Date of Patent: Dec. 7, 2010

(54) CONNECTION STRUCTURE WITH A WORKPIECE AND AN OBJECT

(75) Inventors: Hun-Jen Chen, Taipei Hsien (TW); Li-Yen Liu, Taipei County (TW); Hsiu-Yu Fan, Miaoli County (TW); Tsun-Wu Liu, Taipei (TW)

(73) Assignee: Micro-Star Int'l Co. Ltd., Jung-He, Taipei Hsien (TW)

( * ) Notice: Subject to any disclaimer, the term of this patent is extended or adjusted under 35 U.S.C. 154(b) by 1058 days.

(21) Appl. No.: 11/559,884

(22) Filed: Nov. 14, 2006

(65) Prior Publication Data

US 2008/0041101 A1 Feb. 21, 2008

(30) Foreign Application Priority Data

Aug. 18, 2006 (TW) ..... 95214730 U

(51) Int. Cl.
*B23P 5/00* (2006.01)

(52) U.S. Cl. ..... 428/195.1; 428/209; 428/542.2; 156/256; 156/272.8; 156/298

(58) Field of Classification Search ..... 63/26; 219/121.68, 121.69; 428/295.1, 209, 542.2, 428/614; 156/256, 272.8, 298
See application file for complete search history.

(56) References Cited

U.S. PATENT DOCUMENTS 2,244,637 A * 6/1941 Better ..... 59/80
3,180,112 A * 4/1965 Lefkowitz ..... 63/29.1
3,769,114 A * 10/1973 Weigert ..... 156/59
3,784,235 A * 1/1974 Kessler et al. ..... 285/94
4,089,096 A * 5/1978 Michael ..... 29/896.412
4,323,611 A * 4/1982 Poll ..... 428/67
4,842,921 A * 6/1989 Sorko-Ram ..... 428/187
5,035,097 A * 7/1991 Cornwall ..... 52/220.8
5,361,606 A * 11/1994 Nhaissi et al. ..... 63/26
5,462,786 A * 10/1995 Van Ert ..... 428/171
5,671,613 A * 9/1997 Hoover et al. ..... 63/27
6,536,112 B1 * 3/2003 Gutierrez ..... 29/896.41
6,701,747 B2 * 3/2004 Hartgrove ..... 63/29.1
7,691,221 B2 * 4/2010 Swarovski ..... 156/256
2002/0114912 A1 * 8/2002 House ..... 428/42.3

FOREIGN PATENT DOCUMENTS

JP 07285297 A * 10/1995
JP 2001327311 A * 11/2001
JP 02005211547 A * 8/2005

* cited by examiner

*Primary Examiner*—Samuel M Heinrich
(74) *Attorney, Agent, or Firm*—Winston Hsu; Scott Margo

(57) ABSTRACT

A connection structure includes a workpiece, and a coating layer disposed above the workpiece. A groove is formed on a surface of the coating layer. The connection structure further includes an object installed inside the groove and adhered to the workpiece.

20 Claims, 6 Drawing Sheets

CONNECTION STRUCTURE WITH A WORKPIECE AND AN OBJECT

BACKGROUND OF THE INVENTION

1. Field of the Invention

The present invention relates to a connection structure with a workpiece and an object, and more particularly, to a connection structure with an object adhered inside a groove of the workpiece.

2. Description of the Prior Art

Please refer to FIG. 1. FIG. 1 is a diagram illustrating a small object 10 adhered to a workpiece 12 in the prior art. Adhesive 14 is applied to a top surface of the workpiece 12 or a bottom surface of the small object 10, such as a pebble or a jewel, so as to attach the small object 10 to the workpiece 12. However the adhesive 14 applied between the small object 10 and the workpiece 12 always escapes from the interface between the small object 10 and the workpiece 12 so that refinement of feeling is reduced. The small object 10 often departs from the workpiece 12 because the small object 10 can not be attached to the workpiece 12 tightly. In addition, the small object 10 needs to be positioned on the top surface of the workpiece 12 manually and can not be positioned precisely. It causes various and refined arrangement of the small object 10 can not be applied on the workpiece 12. Furthermore, the small object 10 only can be attached on a cloth cover or a leather cover in a hot melt manner so that the application is limited. There is a need to solve the problem of adhering the small object 10 to the workpiece 12 in the prior art.

SUMMARY OF THE INVENTION

It is therefore a primary objective of the claimed invention to provide a connection structure with an object adhered inside a groove of the workpiece for solving the above-mentioned problem.

According to the claimed invention, a connection structure includes a workpiece, and a coating layer disposed above the workpiece. A groove is formed on a surface of the coating layer. The connection structure further includes an object installed inside the groove and adhered to the workpiece.

According to the claimed invention, a connection structure includes a workpiece. A groove is formed on a surface of the workpiece. The connection structure further includes an object installed inside the groove of the workpiece and adhered to the workpiece.

According to the claimed invention, a method for connecting a workpiece and an object includes: (a)forming a coating layer above the workpiece; (b)forming a groove on a surface of the coating layer; and (c)installing the object inside the groove and adhering the object to the workpiece.

According to the claimed invention, a method for connecting a workpiece and an object includes: (a)forming a groove on a surface of the workpiece; and (b)installing the object inside the groove and adhering the object to the workpiece.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
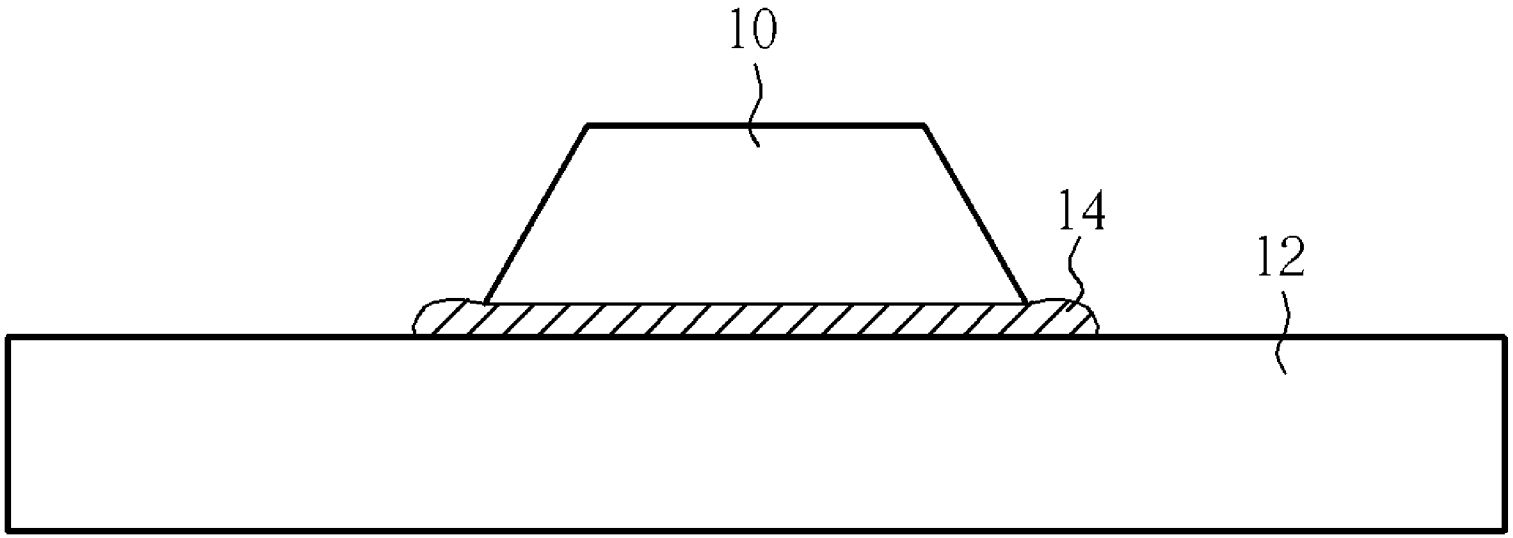
Fig. 1 Prior Art
FIG. 1 is a diagram illustrating a small object adhered to a workpiece in the prior art.
Figure 2:
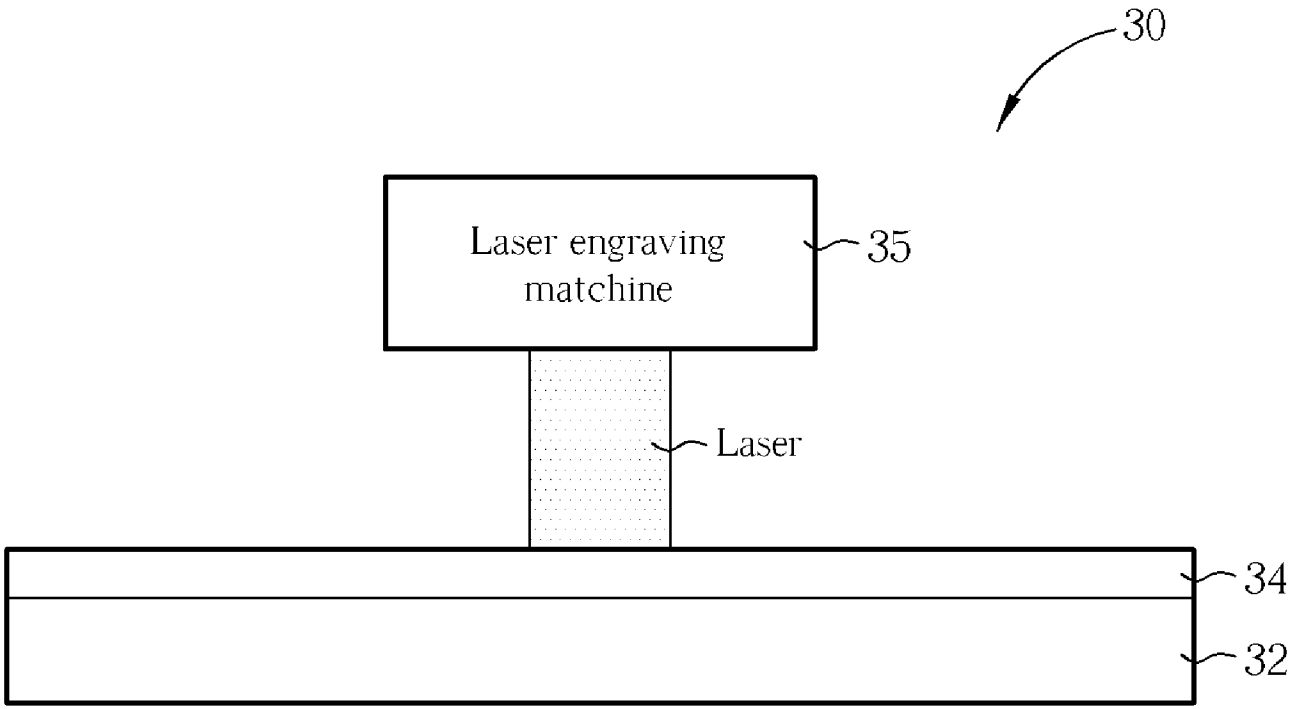
FIG. 2 to FIG. 5 are manufacturing diagrams of a connection structure according to a first embodiment of the present invention.
Figure 3:
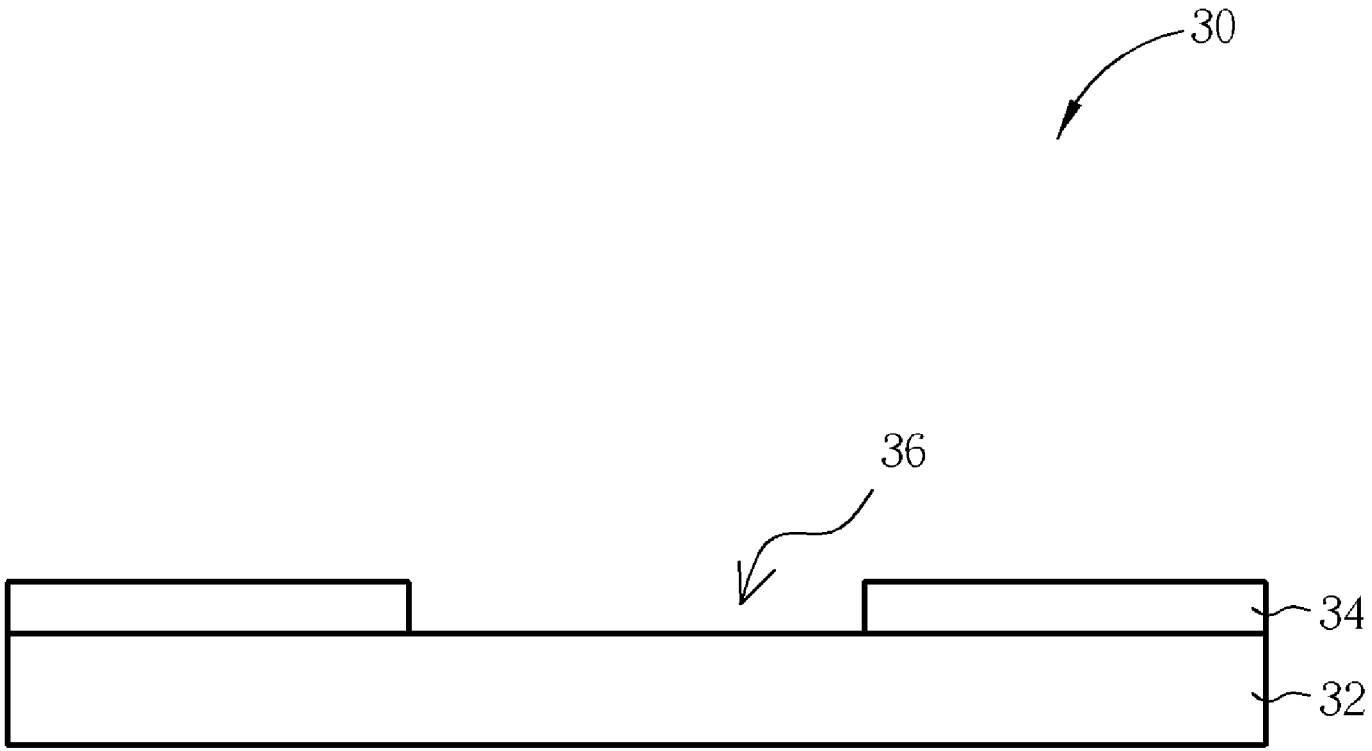

Please refer to FIG. 2 to FIG. 5. FIG. 2 to FIG. 5 are manufacturing diagrams of a connection structure 30 according to a first embodiment of the present invention. The connection structure 30 includes a workpiece 32, and a coating layer 34 disposed above the workpiece 32. The workpiece 32 can be made of metal material, such as a casing of a notebook computer made of magnalium, a casing of a mobile phone, a casing of a watch, a cigarette case, and so on. The coating layer 34 can be spray paint on a surface of the workpiece 32. As shown in FIG. 2, a laser engraving machine 35 engraves the coating layer 34 by laser engraving technique so as to form a groove 36 shown in FIG. 3. A depth of the groove 36 can be adjusted by adjusting output power of the laser engraving machine 35. For example, the depth of the groove 36 can be adjusted to a thickness of the coating layer 34. The laser engraving technique can be controlled by a computer digitally, so after process of the laser engraving technique has a character of precise position. For example, a coordinate location corresponding to the workpiece 32 can be input in the laser engraving machine 35 so as to position the laser engraving location precisely. It can increase variety of a laser engraving pattern or words.

Figure 4:
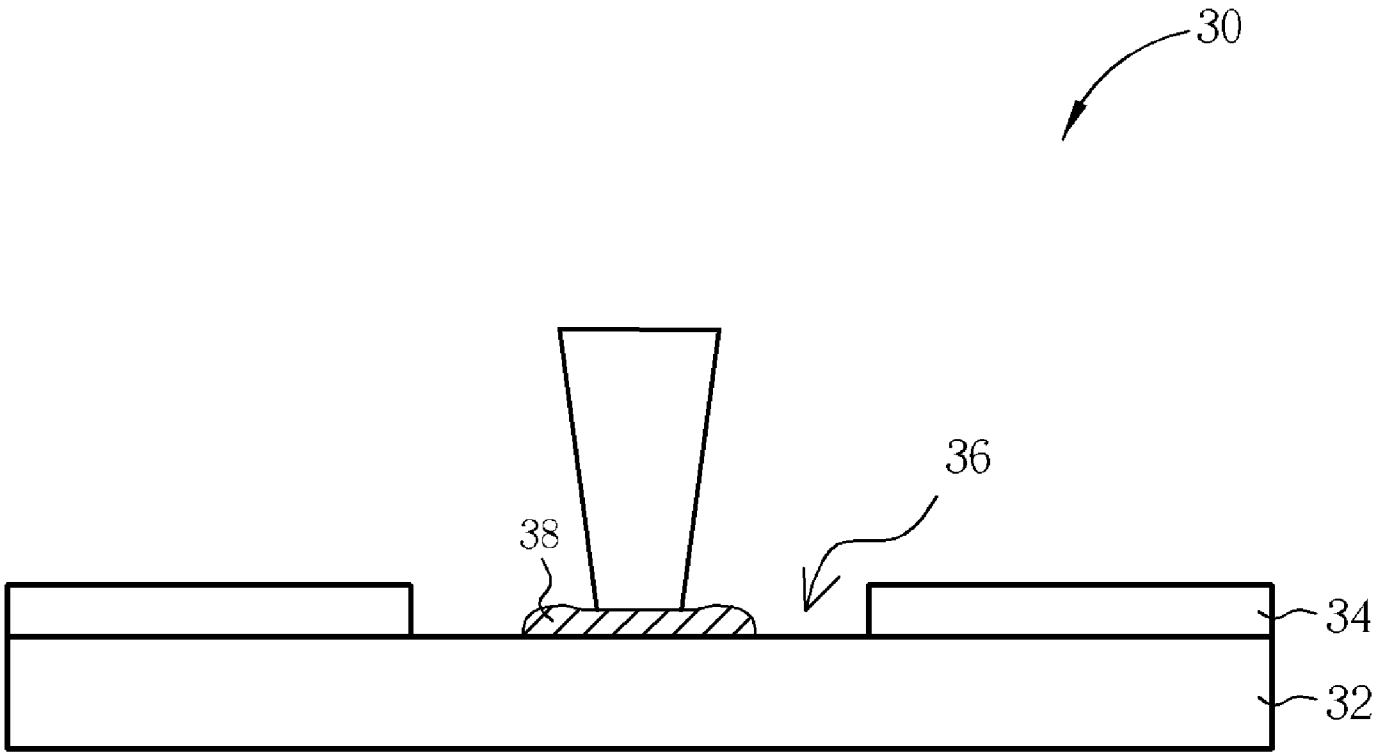
Figure 5:
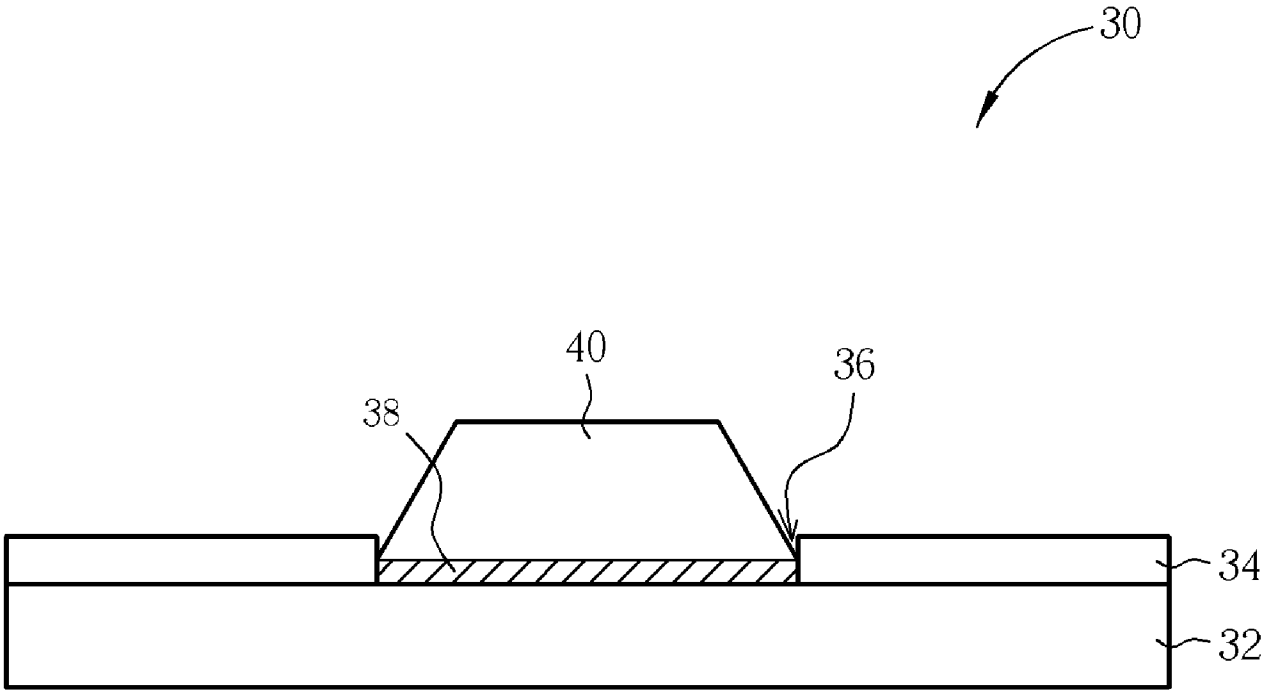

As shown in FIG. 4, after the groove 36 is engraved on the coating layer 34, adhesive 38 can be applied inside the groove 36. Then an object 40 can be installed inside the groove 36 and adhered above the adhesive 38. The object 40 can be a small ornament, such as a pebble or a jewel, or a large object. The object 40 can be installed inside the groove 36 by surface mounting technique for precise position so as to form various patterns on the workpiece 32. Furthermore, the object 40 is wedged and adhered inside the groove 36. The combination of the object 40 and the workpiece 32 is firm, and the groove 36 can contain the run-off adhesive so as to prevent the adhesive 38 from contacting the coating layer 34. In conclusion, the manner of disposing the object 40 to the groove 36 with the adhesive 38 of the present invention includes advantages of precise position, reducing manual cost and error, preventing the run-off adhesive, good adhesion, refinement of feeling, easy process, capability of arranging complicated patterns formed by the objects 40, capability of adhering the object 40 in an irregular shape to the workpiece 32, and so on.

Figure 6:
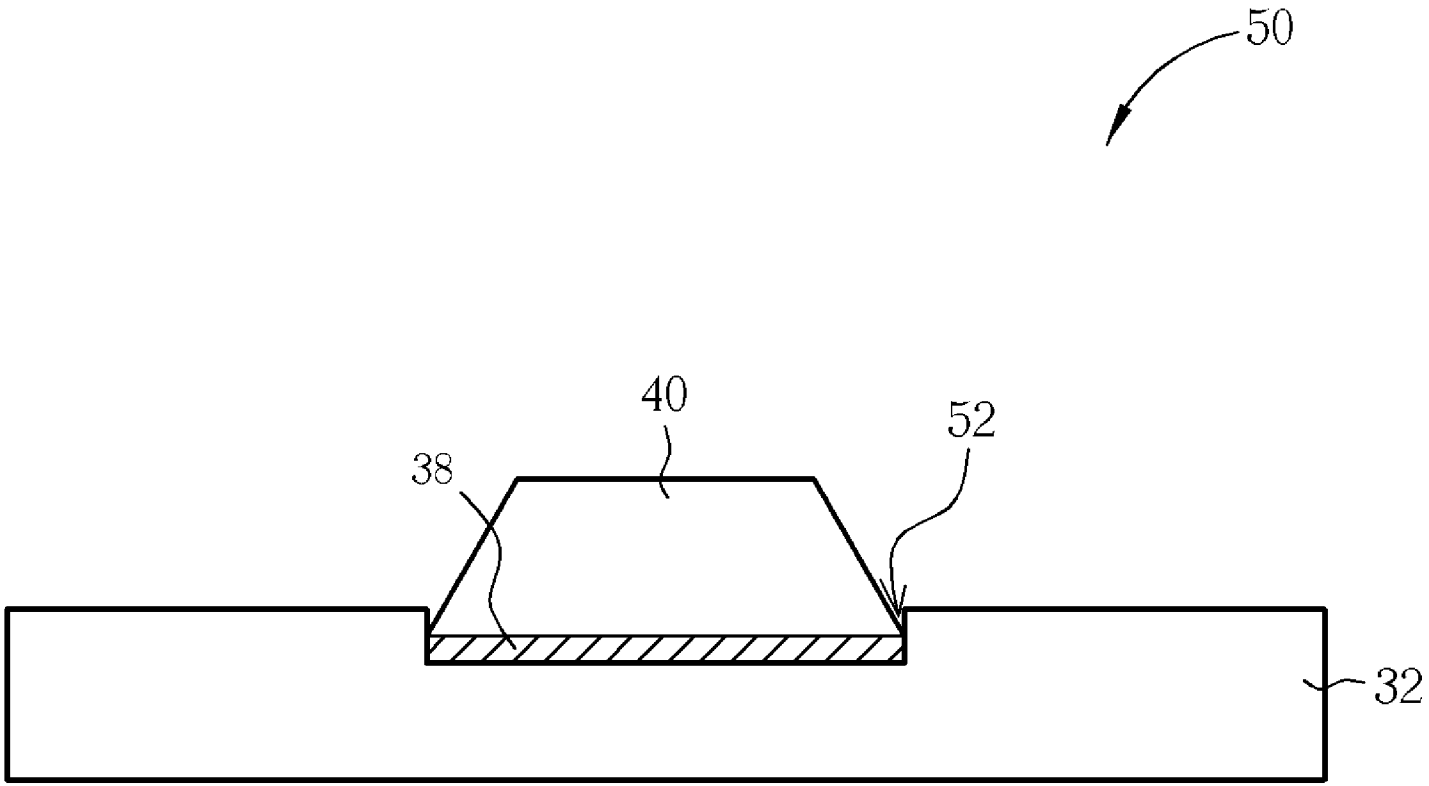
FIG. 6 is a diagram of a connection structure according to a second embodiment of the present invention.

Please refer to FIG. 6. FIG. 6 is a diagram of a connection structure 50 according to a second embodiment of the present invention. The difference between the first embodiment and the second embodiment is that the connection structure 50 includes the workpiece 32 and a groove 52 is formed on a surface of the workpiece 32 directly. The workpiece 32 also can be made of metal material, such as a casing of a notebook computer made of magnalium, a casing of a mobile phone, a casing of a watch, a cigarette case, and so on. The surface of the workpiece 32 can be engraved by laser engraving technique so as to form the groove 52 shown in FIG. 6. A depth of the groove 52 of the workpiece 32 can be adjusted by adjusting output power of the laser. After the groove 52 is engraved on the workpiece 32, the adhesive 38 can be applied inside the groove 52. Then the object 40 can be installed inside the groove 52 and adhered above the adhesive 38. The object 40 can be a small ornament, such as a pebble or a jewel, or a large object. The other principles and advantages of the second embodiment are the same as ones of the first embodiment, and the detailed description is omitted.

In contrast to the prior art, the present invention utilizes after process of laser engraving on mass-produced workpieces without modifying manufacture mold of the workpiece so as to reduce manufacture cost and increase production elasticity. In addition, the manner of disposing the object to the groove with the adhesive of the present invention includes advantages of precise position, reducing manual cost and error, preventing the run-off adhesive, good adhesion, refinement of feeling, easy process, capability of arranging complicated patterns formed by the objects, capability of adhering the object in an irregular shape to the workpiece, and so on. The present invention can combine the crystal pebble or the jewel with the product, such as a notebook computer, a mobile phone, a watch, a cigarette case, and so on. The appearance of the product is refined so as to increase the quality and additional value of the product.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connection structure comprising:

a workpiece;

a coating layer disposed above the workpiece, a groove being formed on a surface of the coating layer;

adhesive applied inside the groove; and an object wedged inside the groove and adhered above the adhesive;

wherein the groove contains the run-off adhesive so as to prevent the adhesive from contacting the surface of the coating layer when the object is adhered inside the groove via the adhesive.

2. The connection structure of claim 1 wherein the workpiece is a casing of a notebook computer.

3. The connection structure of claim 1 wherein the workpiece is made of metal material.

4. The connection structure of claim 1 wherein the groove of the coating layer is formed by laser engraving technique.

5. The connection structure of claim 1 wherein the object is installed inside the groove of the coating layer by surface mounting technique.

6. The connection structure of claim 1 wherein the object is a pebble.

7. The connection structure of claim 1 wherein the object is a jewel.

8. A connection structure comprising:

a workpiece, a groove being formed on a surface of the workpiece;

adhesive applied inside the groove; and an object wedged inside the groove of the workpiece and adhered above the adhesive;

wherein the groove contains the run-off adhesive so as to prevent the adhesive from contacting the surface of the workpiece when the object is adhered inside the groove via the adhesive.

9. The connection structure of claim 8 wherein the workpiece is a casing of a notebook computer.

10. The connection structure of claim 8 wherein the workpiece is made of metal material.

11. The connection structure of claim 8 wherein the groove of the workpiece is formed by laser engraving technique.

12. The connection structure of claim 8 wherein the object is installed inside the groove of the workpiece by surface mounting technique.

13. The connection structure of claim 8 wherein the object is a pebble.

14. The connection structure of claim 8 wherein the object is a jewel.

15. A method for connecting a workpiece and an object comprising:

(a) forming a coating layer above the workpiece;

(b) forming a groove on a surface of the coating layer;

(c) applying adhesive inside the groove; and (d) wedging the object inside the groove and adhering the object above the adhesive, wherein the groove contains the run-off adhesive so as to prevent the adhesive from contacting the surface of the coating layer when the object is adhered inside the groove via the adhesive.

16. The method of claim 15 wherein step (b) comprises forming the groove on the surface of the coating layer by laser engraving technique.

17. The method of claim 15 wherein step (d) comprises wedging the object inside the groove and adhering the object above the adhesive by surface mounting technique.

18. A method for connecting a workpiece and an object comprising:

(a) forming a groove on a surface of the workpiece;

(b) applying adhesive inside the groove; and (c) wedging the object inside the groove and adhering the object above the adhesive, wherein the groove contains the run-off adhesive so as to prevent the adhesive from contacting the surface of the workpiece when the object is adhered inside the groove via the adhesive.

19. The method of claim 18 wherein step (a) comprises forming the groove on the surface of the workpiece by laser engraving technique.

20. The method of claim 18 wherein step (c) comprises wedging the object inside the groove and adhering the object above the adhesive by surface mounting technique.

* * * * *